United States Patent [19]

Demiere

[11] 4,223,426

[45] Sep. 23, 1980

[54] WEB SPREADING ROLL

[75] Inventor: Armand Demiere, Epalinges, Switzerland

[73] Assignee: Arcomac S.A., Lausanne, Switzerland

[21] Appl. No.: 52,235

[22] Filed: Jun. 26, 1979

Related U.S. Application Data

[63] Continuation-in-part of Ser. No. 788,882, Apr. 19, 1977.

[30] Foreign Application Priority Data

Apr. 30, 1976 [CH] Switzerland ..... 5435/76

[51] Int. Cl.[3] ..... D06C 3/06

[52] U.S. Cl. ..... 26/103; 162/271

[58] Field of Search ..... 26/101, 102, 103, 104; 162/271; 29/116 R, 116 AD

[56] References Cited

FOREIGN PATENT DOCUMENTS 2423797 11/1975 Fed. Rep. of Germany ..... 26/101

50-39187 12/1975 Japan ..... 26/104

*Primary Examiner*—Robert Mackey

*Attorney, Agent, or Firm*—Young & Thompson

[57] ABSTRACT

A web-spreading shaft has a central rod with fixed modules aligned thereon. The modules are trapezoidal-shaped, in lateral view, and are aligned in fixed angular relationship along the rod. The latter is stressed axially and thus takes an arcuate shape, according to the angular relationship of the modules. Rotating cylindrical sleeves are aligned on the thus curved shaft. Means are provided for circulating a lubricating fluid between the rotating sleeves and the shaft.

6 Claims, 4 Drawing Figures

WEB SPREADING ROLL

This application is a continuation-in-part of my copending application Ser. No. 788,882, filed Apr. 19, 1977.

The present invention is concerned with a web-spreading roll which can be used e.g. in the paper and textile industry and, broadly speaking, in all machines using continuous webs or fabrics. Such webs usually move under different speed, tension and moisture conditions, which may impart uneven tensions to the web, thus provoking wrinkles when the web path is altered by a cylindrical roll. In order to avoid these wrinkles, the provision of curved rolls in front of straight rolls is known, such as e.g. deviation rolls, press rolls or calendar nip rolls.

Prior art curved rolls normally have a cover, made of rubber or synthetic polymers, extending over the whole surface of the roll and supported by circular bearings mounted along a curved shaft. The curve radii of the known shafts are predetermined and cannot be altered. Moreover, if a bearing has to be replaced after heavy use, dismantling the roll is a fastidious, complicated task and substantially raises costs.

It is an object of the present invention to provide a web-spreading roll of simple construction, capable of being installed and dismantled easily, and also capable of varying the height of the bow during assembly of the axle, beginning with a straight cylindrical shape and varying continuously to a bow shape with a curve radius becoming continuously smaller until a reasonable bow is attained. Each possible curve radius can be maintained perfectly fixed.

The invention is more fully explained in the attached drawing showing the prior art and the embodiments of the invention.

Figure 1:
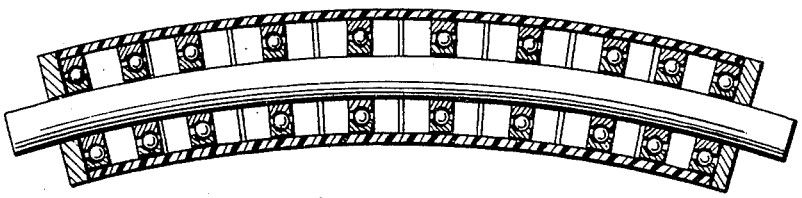
(Prior Art) FIG. 1
FIG. 1 shows a longitudinal section along a prior art web-spreading roll.

A prior art web-spreading roll, as shown in FIG. 1, is generally formed by a central shaft made in one piece of steel, arched by means of a press to give it the necessary curvature. It is obvious that a shaft which has been machined circular when straight will become slightly oval during the curving operation. This shaft is fixed; only the outside part is rotatable, driven by the continuous web which rests on the roll over a given enveloping angle. The rotative part may be driven by friction through the web itself or by means of a separate motor or any other means. In this case, the speed of the roll has to be precisely adapted to the speed of the continuous web.

The prior art web-spreading roll according to FIG. 1 has a continuous rubber sleeve, the purpose of which is to smooth the straight portions of the polygon; connect mechanically the rotatable, cylindrical carrier spools in which ball bearings are provided and close the relative large voids between these spools.

The rubber sleeve is often subject to severe wear, necessitating high maintenance costs and lengthy idle periods during replacement.

Other known web-spreading rolls avoid the rubber sleeve and spread the web directly with metal carrier spools supported by the ball bearings, whereby the spools have to be assembled with large voids, not suitable for certain webs.

These drawbacks are overcome by the web-spreading roll according to the present invention, an embodiment of which is now explained with reference to FIGS. 2–4.

Figure 2:
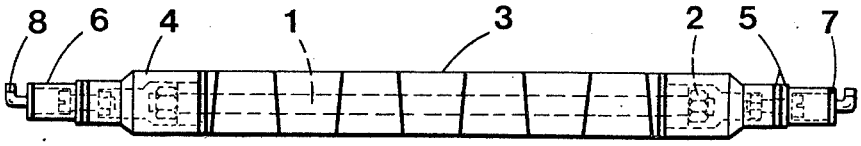
FIG. 2 shows a lateral view of an embodiment of a central shaft according to the invention, in straight shape.
Figure 3:
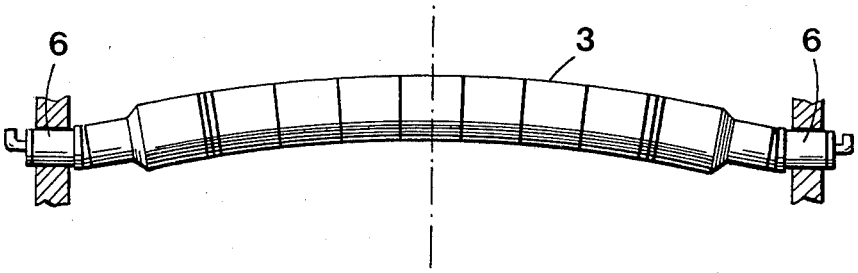
FIG. 3 shows a lateral view of the shaft of FIG. 2, but in arcuate shape.

According to FIGS. 2 and 3, the central shaft comprises a number of axle modules 3, machined perfectly circular, cylindrical and with angular faces, prescribing geometrically trapezoidal pieces, these being aligned on a rod 1 having a tightening and blocking arrangement on each end, the purpose of said arrangement being to hold the rod 1 under tension.

If said modules 3 are fitted onto the rod 1 and turned alternatively through 180° in relation to each other, the completed axle will be straight, when stressed, as shown in FIG. 2.

If said modules 3 are fitted onto the rod 1 and turned with all long sides aligned, the completed shaft will have a polygonal bow with a maximum predetermined height, when the rod 1 is prestressed, as shown in FIG. 3.

If the said modules 3 are fitted and turned on the rod 1 through less than 180°, any polygonal bow between zero and the maximum predetermined bow can be obtained when the rod 1 is prestressed.

The shaft has an axle end module 4, fitted and locked onto the stressed rod 1 at each end, regulating rings 5 and axle stub ends 6 in such a way that the latter can be aligned coaxially.

Sealed axle covers 7 equipped with fittings 8 are fitted on the facial ends of the axle stub ends, allowing a lubricating and cooling liquid to enter and to leave the space between the axle and the sleeve, through apertures in the axle and modules 4.

Figure 4:
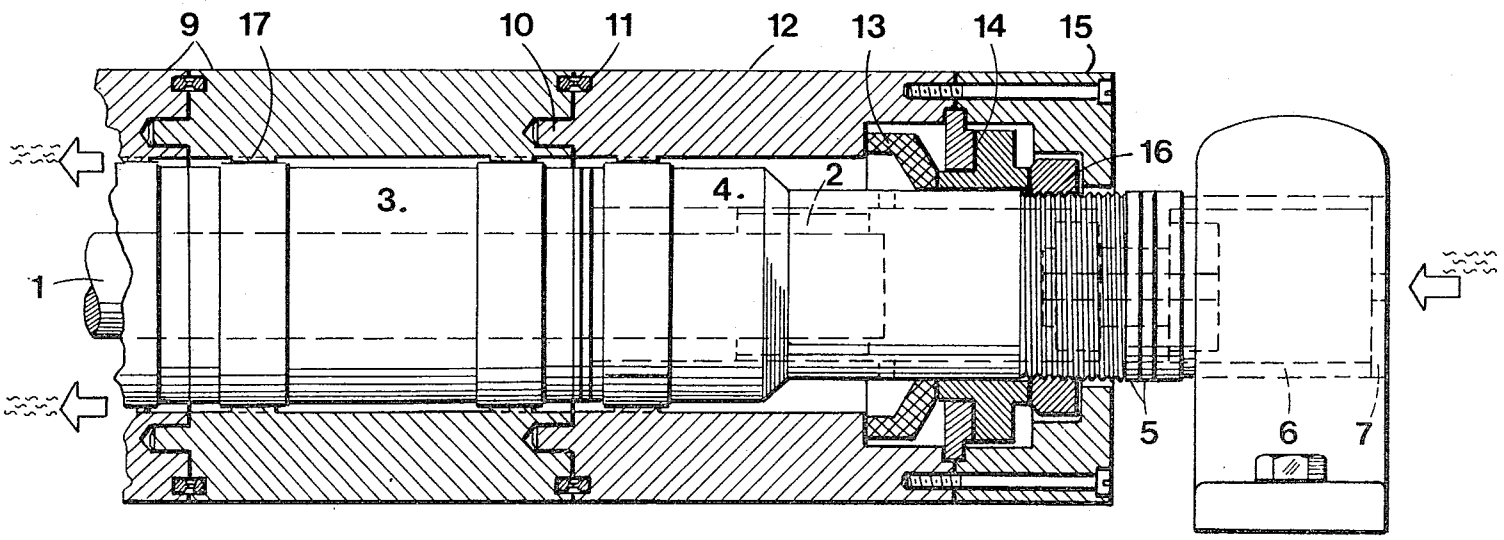
FIG. 4 shows a longitudinal section of a web-spreading roll having a shaft according to FIGS. 2 and 3.

According to FIG. 4, the number of sleeve modules 9 corresponds to the number of axle modules, which are mechanically interconnected by pins 10 and sealed against each other against the inside and the outside by seals 11 made of a resilient material. The two sleeve end modules 12 are each equipped with a seal 13 closing the roll inside before the end bearings 14 and the sleeve covers 15 are fitted.

The complete sleeve is axially held in position by bearings and locking nuts 16 on each end.

Each sleeve module 9 as well as the two sleeve end modules 12 are equipped with exchangeable self-lubricating friction bearings 17.

A lubricating and cooling fluid: oil, water or any other suitable medium, can be introduced through the fitting 8 on one axle end and leave at the other axle end, through fitting 8, creating inside the roll a film between the rotating sleeve and the stationary shaft. Due to continuous circulation of the fluid, all rotating and moving parts inside the roll are lubricated, and heat is permanently dissipated by this fluid.

I claim:

1. A web-spreading roll, comprising a stationary central rod, a plurality of stationary identical cylindrical modules having a symmetrical trapezoidal-shaped section along their axis, said modules being disposed on said rod in an identical fixed angular position to each other, stressing means disposed at both ends of said rod to impart stress to the rod in its lengthwise direction and to urge said modules together in frictional engagement to each other, thus imparting to said stationary rod with said stationary modules an arcuate shape, the radius of the arc depending on said angular position, a plurality of identical cylindrical sleeves disposed along said modules, means disposed between said modules and said sleeves for permitting rotation of the sleeves around said modules, and means associated with said sleeves for assuring simultaneous and uniform rotation of all sleeves together.

2. A roll according to claim 1, wherein said means permitting rotation comprise two substantially ring-shaped bearings on each of said stationary modules.

3. A roll according to claim 2, wherein the number of sleeves is equal to the number of stationary modules.

4. A roll according to claim 1, further comprising means for circulating a lubrication and cooling fluid between said modules and said sleeves, said means comprising inlet and outlet connections for said fluid and sealing means at both ends of the shaft consisting of said rod and said modules, said inlet and outlet connections being provided between the stationary shaft and the rotating sleeves.

5. A roll according to claim 4, further comprising substantially ring-shaped elastic sealing means disposed in circular grooves the sleeves.

6. A roll according to claim 5, wherein said ring-shaped sealing means are of resilient material.

* * * * *